US005157898A

United States Patent [19]

Zanini et al.

[11] Patent Number: 5,157,898

[45] Date of Patent: Oct. 27, 1992

[54] APPARATUS FOR APPLYING CLOSURES TO CONTAINERS

[75] Inventors: Gianpietro Zanini, Montanara; Carlo Corniani, Marmirolo, both of Italy

[73] Assignee: Azionaria Costruzioni Macchine Automatiche A.C.M.A. S.p.A., Bologna, Italy

[21] Appl. No.: 803,829

[22] Filed: Dec. 9, 1991

[30] Foreign Application Priority Data

Dec. 20, 1990 [IT] Italy ..... 3780 A/90

[51] Int. Cl.[5] ..... B67B 3/28; B67B 3/20

[52] U.S. Cl. ..... 53/367; 53/331.5

[58] Field of Search ..... 53/367, 329, 331, 331.5, 53/287, 317

[56] References Cited

U.S. PATENT DOCUMENTS

| | | | |
|---|---|---|---|
| 3,714,760 | 2/1973 | Roberts et al. | 53/331.5 X |
| 3,882,660 | 5/1975 | Sterling | 53/367 X |
| 4,506,489 | 3/1985 | Schieser et al. . | |
| 4,653,676 | 3/1987 | Stull | 53/367 X |
| 4,696,143 | 9/1987 | Young | 53/367 X |
| 4,993,537 | 2/1991 | Bianchini et al. | 53/367 X |
| 5,095,681 | 3/1992 | Choi | 53/367 X |

FOREIGN PATENT DOCUMENTS 2128789 10/1972 France .

*Primary Examiner*—Horace M. Culver

*Attorney, Agent, or Firm*—Guido Modiano; Albert Josif

[57] ABSTRACT

The apparatus for applying closures to containers having a neck which is inclined with respect to a vertical axis of the containers comprises: a first conveyer and a second conveyer for transferring the containers in succession. A closure application conveyor receives containers from the first conveyor and transfers them to the second conveyer. The closure application conveyor is provided with a plurality of clamps for gripping the containers arriving from the first conveyer, and is provided with a plurality of closure application heads whose respective lines of action are inclined with respect to a vertical axis. Actuation devices are provided which rotate the clamps in both directions about the vertical axes of the related containers in order to align the axes of the necks with the lines of action of the respective closure application heads.

2 Claims, 2 Drawing Sheets

APPARATUS FOR APPLYING CLOSURES TO CONTAINERS

BACKGROUND OF THE INVENTION

The present invention relates to an apparatus for applying closures to containers.

In particular, the present invention relates to an apparatus for applying closures to containers, such as bottles, flasks and the like, whose neck is inclined with respect to a vertical longitudinal axis of the containers themselves.

In known devices for applying closures to containers having inclined necks, the containers arriving from a filling unit which has filled them with liquid or powder-like substances are fed in succession, in a vertical arrangement, to grip elements which belong to a rotating input carousel and are transferred in succession from said rotating carousel to respective grip elements of a rotating closure application carousel.

While the containers are on the input carousel or on the closure application carousel, they are rotated by the related grip elements so that their neck is arranged vertically. This arrangement in fact facilitates the subsequent operation of applying a closure thereon.

Said devices are functional and reliable only as long as their operating speed does not exceed certain values, since for particularly high operating speeds said rotation of the containers can give rise to malfunctions of the devices themselves. Sudden rotation of the described type, performed at high speed, can in fact easily cause spilling of liquid from said containers.

SUMMARY OF THE INVENTION

The aim of the present invention is to provide an apparatus of the described type which does not give rise to the described disadvantage and is capable of operating correctly even at particularly high operating speeds.

According to the present invention, an apparatus is provided for applying closures to containers having a neck extending along an axis which is inclined with respect to a vertical axis of said containers, said apparatus comprising first conveyance means and second conveyance means for the transfer of said containers in succession, and a closure application conveyor suitable for receiving said containers from said first conveyance means and for transferring them to said second conveyance means; said closure application conveyor comprising means for gripping the containers arriving from said first conveyance means, characterized in that it comprises a plurality of closure application heads whose respective lines of action are inclined with respect to the vertical, as well as actuation means suitable for making said grip means rotate in both directions about said vertical axes of said related containers between a first position and a second position at which the axes of the necks of said containers are respectively not aligned and aligned with the lines of action of said respective closure application heads; said closure application heads applying the related closures to said containers while the axes of the necks of said containers are aligned with the lines of action of the related closure application heads.

BRIEF DESCRIPTION OF THE DRAWINGS

The present invention is now described with reference to the accompanying drawings, which illustrate a nonlimitative embodiment thereof, wherein.

Figure 1:
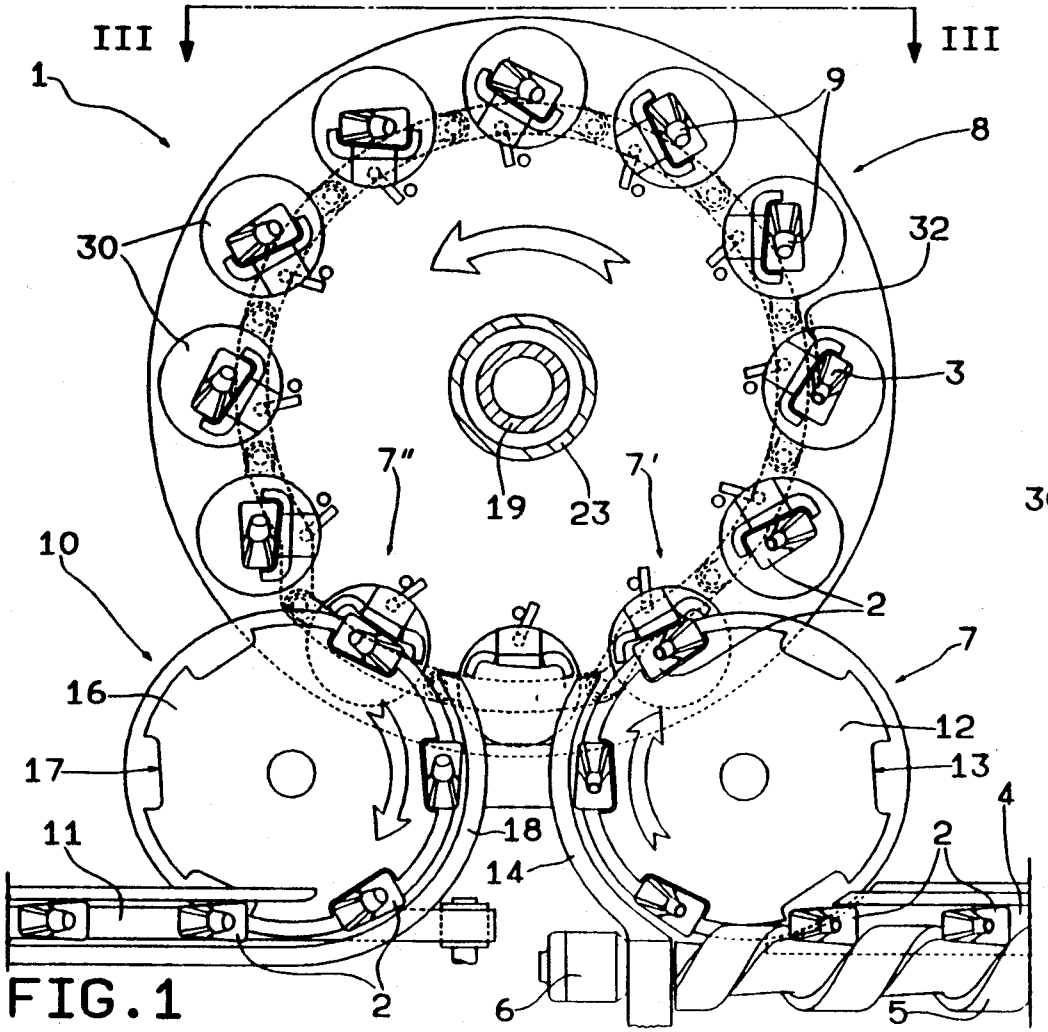
FIG. 1 is a schematic plan view, with parts removed for greater clarity, of a portion of a filling machine which includes an apparatus for applying closures to containers, executed according to the teachings of the present invention.

DESCRIPTION OF THE PREFERRED EMBODIMENTS reference to FIG. 1, the reference numeral 1 generally designates a filling machine which is only partially illustrated and is suitable for filling with liquid substances, and for applying closures to, containers 2 having a neck 3 which is inclined with respect to a vertical axis of said containers 2.

The machine 1 comprises an apparatus 1' for applying closures to containers, which in turn comprises feeder means constituted by a horizontal belt conveyor 4 flanked and partially surmounted by a worm-screw conveyor 5 motorized by a motor 6, capable of transferring in succession the containers 2 (already filled with liquid by sections of the machine which are not illustrated) toward a rotating conveyor 7, which is capable of transferring the containers 2 along a circular path.

At an input station 7', the conveyor 7 transfers in succession the containers 2 to a closure application conveyor or rotating closure application carousel 8, which applies closures 9 to the containers 2 and transfers the closed containers 2, at an output station 7'', to a further rotating output conveyor 10 which guides the containers 2 onto a horizontal belt conveyor 11 transporting them toward further processing stations which are not illustrated.

The rotating conveyor 7 essentially comprises a drum 12 having a vertical axis, which rotates (clockwise with reference to FIG. 1) and has, on its periphery, a plurality of mutually equidistant recesses 13, each of which is adapted for accommodating a container 2 arranged so that its axis is vertical. The periphery of the drum 12 is flanked by a curved fixed guide 14 which has the function of maintaining the containers 2 within the recesses 13 during transfer on the conveyor 7.

The closure application carousel 8 comprises (see also FIG. 3) a substantially cylindrical conveyance head 15 which counter-rotates with respect to the conveyor 7 and is substantially tangent thereto.

The rotating conveyor 10 essentially comprises a drum 16 having a vertical axis, which rotates clockwise (with reference to FIG. 1) and has, on its periphery, a plurality of mutually equidistant recesses 17, each adapted for accommodating a container 2, which arrives from the closure application carousel 8 and is arranged so that its axis is vertical. The periphery of the drum 16 is flanked by a curved fixed guide 18 which has the function of maintaining the containers 2 within the recesses 17 during their transfer by means of the conveyor 10.

Figures 3, 4:
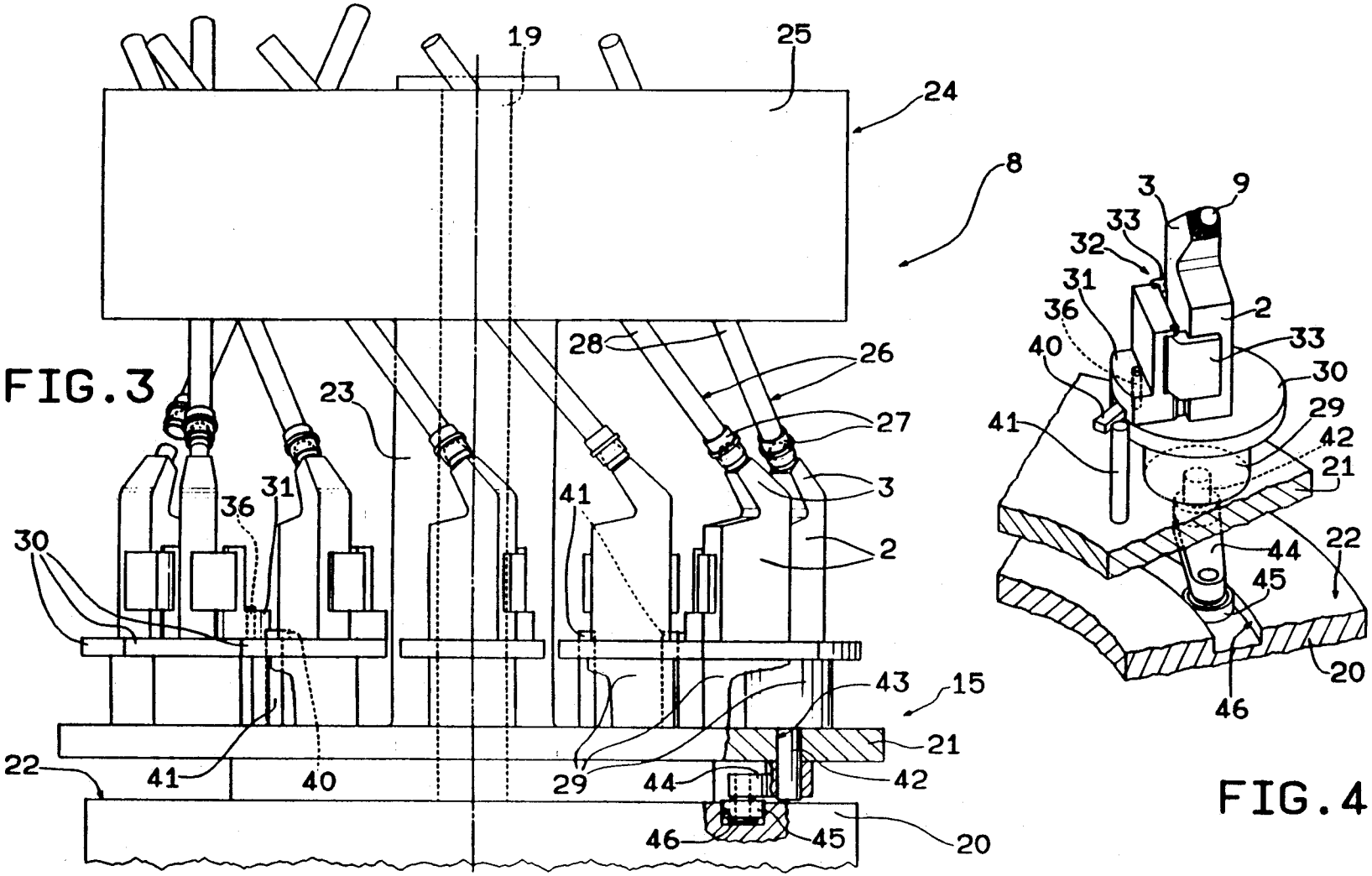
FIG. 3 is a schematic elevation view of the apparatus illustrated in FIG. 1.
FIG. 4 is an enlarged-scale perspective view of a detail of FIG. 3.

According to what is illustrated in particular in FIGS. 1 and 3, the closure application carousel 8 comprises a vertical shaft 19 rotatably supported by the base 20 of the machine 1 and connected, in a manner (e.g., a known kinematic transmission) which is not illustrated, to motor means (e.g. a conventional electric motor) which are not illustrated.

The shaft 19 supports, in a manner (e.g., conventional collar or flange and/or key means) which is not illustrated, a disk-like body 21 which is coaxial thereto and is adjacent to an upper horizontal plate 22 of the base 20; a known closure application unit 24, which will not be described in detail hereinafter since it does not per se constitute the subject of the present invention, is connected to the upper surface of said plate 22 by means of a hollow cylindrical body 23. Said closure application unit 24 essentially comprises a cylindrical body 25 which is coaxial to the shaft 19 and from whose lower face known and angularly mutually equidistant closure application means, or closure application heads 26, extend downward. Each closure application head 26 essentially comprises a closure application tool 27 supported by the lower end of a shaft 28 which is inclined with respect to a vertical axis in the same manner as the necks 3 of the containers 2. Each closure application head 26, in order to apply a closure to a container 2, is capable of sliding, under the action of actuation means (such as e.g., conventional fluid activated cylinders or spring and/or cam means) which are not illustrated, along the axis of the related shaft 28, which therefore constitutes its line of action, and of rotating in both directions about said axis.

Said disk-like body 21 supports, in an upward position and in an axially rotatable manner, proximate to its own periphery, a plurality of cylindrical elements 29 which have a vertical axis, are uniformly distributed and support, in an upward position, respective circular plates 30 which are coaxial and rigidly connected thereto.

Figure 2:
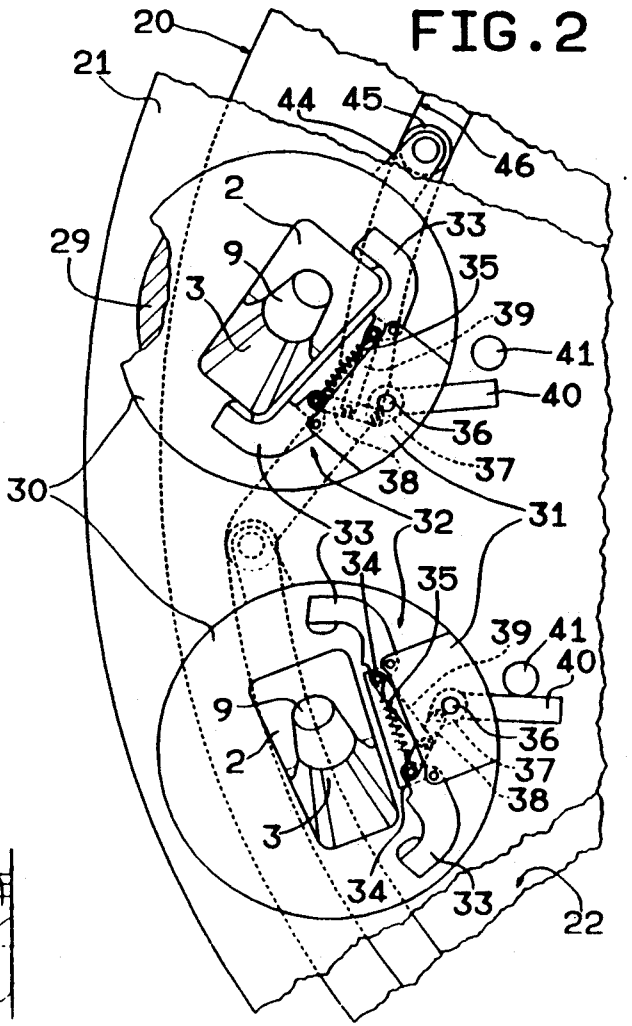
FIG. 2 is a partially sectional enlarged-scale view of a detail of FIG. 1.

According to what is illustrated in particular in FIGS. 2 and 4, a block 31 is fixed to the upper surface of each plate 30 at a portion thereof which is radially internal to the disk-like body 21, and supports, in an upward position (see in particular FIG. 2) a clamp or grip means 32. Each clamp 32 comprises two substantially L-shaped jaws 33 pivoted to the block 31 with a respective end and have, proximate to said end, a wing 34 which is directed toward the other jaw 33. Said wings 34 are mutually connected, within each clamp 32, by a helical traction spring 35, and each block 31 is crossed by a vertical pivot 36 at a region which is arranged substantially central in plan view.

According to what is illustrated in particular in FIG. 2, a horizontally extending disk 37 is keyed on a portion of the pivot 36 which is arranged substantially at the same level as the wings 34; an end of a connecting rod 38 is pivoted on a portion of said disk 37 which is eccentric with respect to the axis of said pivot 36, and the other end of said connecting rod is pivoted to a wing 34 at the coupling point of an end of the spring 35. A connecting rod 39, has one end pivoted to an intermediate point of said connecting rod 38, and another end pivoted to the point whereat said spring 35 is coupled to the other wing 34.

An end of a horizontal bar 40 is keyed at a median region of each pivot 36 (FIG. 4); the free end of said horizontal bar is arranged, for reasons which will become apparent hereinafter, proximate to a vertical pin 41 whose lower end is rigidly associated with the upper surface of the disk-like body 21.

According to what is illustrated in particular in FIG. 3, wherein the connection between one of the cylindrical bodies 29 and the disk-like body 21 has been shown in a rather detailed manner, each cylindrical body 29 is rigidly connected, in a downward position, to a pivot 42 which is coaxial thereto and is rotatably inserted within a hole 43 defined in the disk-like body 21. Below said disk-like body 21, each pivot 42 rigidly supports an end of a horizontal lever 44 whose free end supports a cam-following means, constituted by a free roller 45 with a vertical axis, which is engaged within a track 46 which constitutes a cam-like means defined in the upper portion of the disk-like body 21. The details designated with the numerals 44 to 46 will also be termed hereinafter, for reasons which will become apparent from the description of the operation of the apparatus 1, according to the invention, actuation means suitable for imparting to the grip means 32 a rotation in both directions about the vertical axes of the related containers 2.

In use, the liquid-filled containers 2 to be closed are guided in succession by the belt conveyor 4 and by the worm-screw conveyor 5 into respective recesses 13 of the rotating conveyor 7.

Said conveyor 7 then transfers the containers 2 in succession between the jaws 33 of respective clamps 32 of the closure application unit 24.

Immediately after a container 2 has been arranged between two jaws 33 of a clamp 32, the roller 45 related to said clamp 32 produces, under the action of the cam-like means 46, an axial clockwise rotation of the related cylindrical body 29 (see FIGS. 2 and 3 in particular) so as to align the axis of the neck 3 of said container 2 with the axis of a related shaft 28 which extends downward from the closure application unit 24. As a consequence of this rotation, the bar 40, which previously rested against the related pin 41 in order to keep the jaws 33 open against the biasing action of the spring 35, causes the jaws 33 to pass, under the pulling action of said spring 35, from the position illustrated in the lower portion of FIG. 2 to the position illustrated in the upper part of said figure.

As a consequence of this, the container 2 being considered is firmly gripped between the jaws 33 of the related clamp 32, and the related closure application head 26 applies a closure 9 to the underlying neck 3 in a known manner.

When each closed container 2 reaches the output station 7'', the cam-like means 46 produces, by means of the roller 45, a counterclockwise rotation of the related cylindrical body 29 so as to return said container 2 to the initial position assumed at the input station 7'. As a consequence of this rotation, the bar 40 returns to rest against the related pin 41, causing the jaws 33 to pass, against the pulling action of the spring 35, from the closed position illustrated in the upper portion of FIG. 2 to the open position illustrated in the lower part of said figure.

The closed container 2 is then transferred into a recess 17 of the output conveyor 10, which in turn transfers the containers 2 to the belt conveyor 11.

From what has been described it is evident that the described apparatus is capable of applying closures 9 to containers 2 whose neck is inclined with respect to the vertical without having the disadvantages described with reference to the known art.

The described rotation of the containers 2 supported by the clamps 32 in fact occurs without causing losses of liquid from said containers 2.

It should be noted that the described movements of the grip means 32 might be caused by actuation means of any kind, different from those examined, and that said grip means 32 might be provided in a manner differing from the described one.

We claim:

1. Apparatus for applying closures to containers having a neck extending along an axis which is inclined with respect to a vertical axis of the containers themselves, said apparatus comprising first conveyance means and second conveyance means for transferring said containers in succession, and a closure application conveyor suitable for receiving said containers from said first conveyance means and for transferring them to said second conveyance means; said closure application conveyor comprising means for gripping the containers arriving from said first conveyance means, said apparatus further comprising a plurality of closure application heads whose respective lines of action are inclined With respect to the vertical, as well as actuation means suitable for making said grip means rotate in both directions about said vertical axes of said related containers between a first position and a second position at which the axes of the necks of said containers are respectively not aligned and aligned with the lines of action of said respective closure application heads; said closure application heads applying the related closures to said containers while the axes of the necks of said containers are aligned with the lines of action of the related closure application heads.

2. Apparatus according to claim 1, wherein said closure application conveyor is constituted by a rotating carousel which supports a plurality of said equidistant grip means, each being capable of rotating about a respective substantially vertical axis, said actuation means comprising cam-like means which engage cam-follower means which are associated with said grip means.

* * * * *